US005588176A

United States Patent [19]

Sixsmith

[11] Patent Number: 5,588,176

[45] Date of Patent: Dec. 31, 1996

[54] WATER RECOVERY WASH BRUSH

[75] Inventor: Thomas G. Sixsmith, 21812 Bass Lake Cir., Lake Forest, Calif. 92630

[73] Assignee: Thomas G. Sixsmith, Lake Forest, Calif.

[21] Appl. No.: 488,176

[22] Filed: Jun. 12, 1995

[51] Int. Cl.[6] ..... A47L 9/06

[52] U.S. Cl. ..... 15/322; 15/360; 15/399

[58] Field of Search ..... 15/114, 320–322, 15/345, 360, 399, 415.1

[56] References Cited

U.S. PATENT DOCUMENTS

| | | | |
|---|---|---|---|
| 1,821,715 | 9/1931 | Kuchinsky | 15/322 |
| 2,932,840 | 4/1960 | Lathrop | 15/114 |
| 3,161,900 | 12/1964 | Hornsuch et al. | 15/345 |
| 3,186,021 | 6/1965 | Krier et al. | 15/345 |
| 3,538,535 | 11/1970 | Ginsburgh et al. | 15/322 |

FOREIGN PATENT DOCUMENTS

| | | | |
|---|---|---|---|
| 744466 | 2/1956 | United Kingdom | 15/345 |

*Primary Examiner*—David Scherbel
*Assistant Examiner*—Terrence R. Till

[57] ABSTRACT

This invention relates to the automotive appearance industry and more particularly to an environmentally improved vehicle washing system.

5 Claims, 2 Drawing Sheets

WATER RECOVERY WASH BRUSH

BACKGROUND OF THE INVENTION

It is been known that federal environmental (EPA) laws require control of environmental discharges into storm drains and runoff from possible polluting sources including most types of car and truck washes, mobile or stationary. Washing vehicles requires soap and water applied in varying amounts during the washing process. If conditions warrant the necessity to recover used soap and water, many mobile wash operators use portable recovery mats placed under the vehicle to collect used wash water. The waste water is collected and pumped to a receiving tank for proper disposal at a later time. This method of collection is time consuming and difficult to implement.

SUMMARY OF THE INVENTION

In the art of water cleaning devices there has been known inventions shown in U.S. Pat. No. 1,821,715 issued Sep. 1, 1931 to M. K. Kuchinsky, U.S. Pat. No. 3,538,535 issued Nov. 10, 1970 to I. Ginsburgh et al., U.S. Pat. No. 3,161,900 issued to H. Hornschuch, wherein a cleaning brush is used to collect dirt and water using a wash head with bristles, a water supply and a vacuum source. U.S. Pat. No. 744,466 issued Feb. 8, 1956 to Hopton Fownes Hamilton, uses air instead of pressurized water. In all cited inventions, an air pervious layer is below the air impervious layer which is a key distinction from the present embodiment. None of these devices or those shown in U.S. Pat. Nos. 2,239,183 issued Apr. 22, 1941 to H. D. Willard, 3,186,021 issued Jun. 1, 1965 to K. N. Krier et al, 2,350,949 issued Jun. 6, 1944 to W. Weimer, would be capable of successful vehicle washing with soap/water recovery as described by the present embodiment.

The requirement to recover wasted water for vehicle washing, necessitated by recently enacted laws, has not been a consideration in prior inventions. Maintaining water tight suction when converging a cleaning device over an irregular surface would be an improvement over existing devices. The main advantage being the ability to capture used waste water from the cleaning process before it is discharged to the surroundings thus complying with federal environmental pollution laws.

It is the intention of the invention to overcome the shortcomings and objections to the prior art by providing an improved cleaning device that is suitable for automobile and trucks finishes by applying a pressurized mixture of soap and water within a circular brush head made from an inner ring of cleaning bristles and successive layers of flexible foam skirts made from air impervious materials.

An objective of the present invention is to provide an improved automotive cleaning device that captures water before it can fall to the ground or surroundings, thereby preventing unlawful environmental discharge to adjacent sewers, steams or ground water runoff.

Another objective of the invention is to provide an improved soap/water cleaning device that is capable of quickly cleaning delicate surfaces such as automobile and truck finishes without damage.

Another objective of the invention is to provide an improved soap/water cleaning device that greatly reduces the amount of water needed to accomplish an effective wet washing method for automobiles or trucks.

Another objective is to provide an automotive cleaning device using a water delivery system coupled with a vacuum source working in tandem that can be used on an automobile surface and then quickly modified if needed to convert into an upholstery cleaning device.

These objectives and others are achieved by providing a hollow frame means to which is attached a series of air impervious flexible brush bristles, a suction method and a means of delivery of a pressured mixture of soap and water or water only. A vacuum hose, with integral water delivery line, to which a hand controlled valve is positioned at or about a distance of a normal hands spans away, or about four feet from the cleaning head, and is utilized to regulate the flow of fluid. Connection to a suitable vacuum source provides a means to capture and control unwanted liquid discharge from and about the brush cleaning head when applied against the surface being cleaned.

Although the principles of the present invention are broadly applicable to the automotive cleaning industry, the invention may also be applicable to other industries, surfaces and textures.

A BRIEF DESCRIPTION OF THE DRAWINGS

DESCRIPTION OF THE PREFERRED EMBODIMENT

Figure 1:
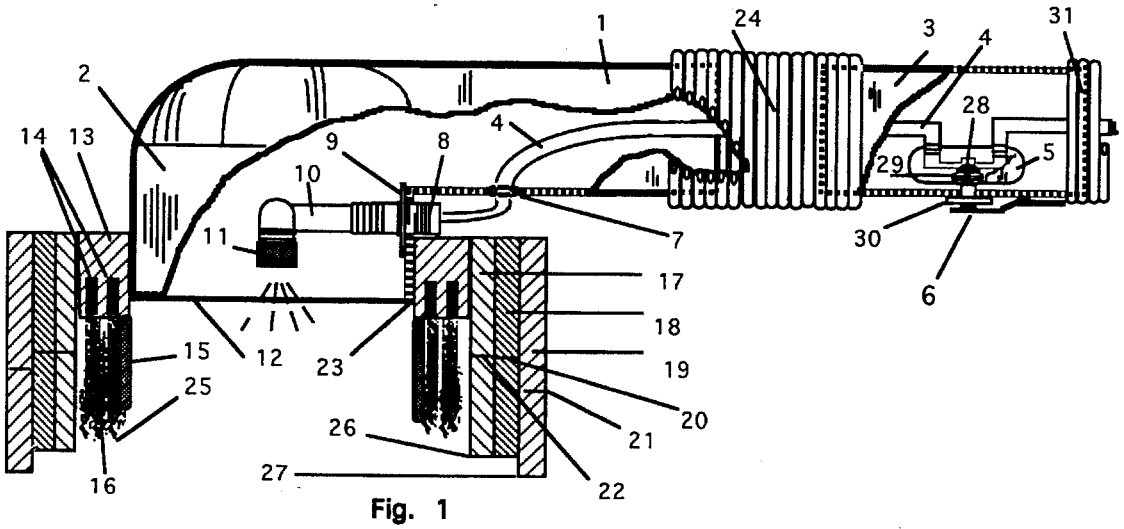
FIG. 1 is a vertical partly sectional view of the cleaning brush and operation valve.

With specific reference to FIG. 1, a frame means or cleaner head is indicated generally by the reference numeral 2. As a means of attachment of a flexible vacuum hose 24 of a suction means to the frame 2, a cylindrical portion 1 is provided on the frame. A flexible vacuum hose 24, is provided with suitable length to allow operation of cleaner head 2, and fluid control valve 5 between the spans of two hands of the operator (about 4 feet length) is secured to the cylindrical portions 1 and to the outlet side of valve frame 3 in a manner to provide leak proof connections between hose 24, and frame 1 and valve frame 3. This allows operation of cleaner head in one hand and regulation of fluid flow via the control valve which is held by the opposite hand, which will be described later. Flexible vacuum hose 31 is connected to the inlet side of the cylindrical portion of valve frame 3 by a leak proof connection and connected to any suitable vacuum source of suction.

For the purpose of delivery of a pressurized fluid such as a soap and water mixture, a flexible hose 4 of a pressurized fluid means connected to the inlet and outlet of control valve 5 by leak proof means, is also provided and is secured within the vacuum hose 24 thus keeping tube 4 from becoming entangled during operation and protrudes through a hole in cylindrical portion 1 through a protective grommet 7 to a suitable tubing connector 8. Control of pressurized fluid flow is regulated by means of a manually operated spring-to-close valve 5, mounted to valve frame 3 by locking nut 30, or other suitable means, which is threaded to valve body 5. Actuation or valve handle 6 opens and unseats valve seat 28 by lever actuation of a handle or finger depressing lever 6, which is normally closed due to spring 29 tension acting with suitable force on the valve seat 28.

Tubing connector 8 is secured to the cleaner head 2 by means of a locking nut 9 that is threaded about tubing connector 8 and inserted through a hole 33 drilled in cleaner head 2 that is positioned about the centerline of cylindrical portion 1. Tubing connector 8 has a shoulder area 32 that presses about hole 33 in cleaner head 2 when locking nut 9 is tightened against shoulder area 32. Tubing connector 8 has a threaded pipe connector opposite tubing connector side that accepts a right angle or 90° brass or plastic elbow 10. Elbow 10 when connected to tubing connector 8 positions the outlet of elbow 10 about the center of cleaner head 2 opening 12. A spray nozzle 11, designed to project a spray of water in a circular pattern through opening 12 of cleaner head 2 is threaded or suitably connected into elbow 10.

Cleaner head 2 is fitted with a series of cleaning brushes as described herein. A plastic or other suitable material circular brush ring 13 has drilled about the inner core, rows of holes 14 equally spaced and completely around the ring 13 to which brush bristles 16 are mechanically or otherwise fastened to the holes 14 by bunching groups of brush bristles of suitable length about the midpoint with a combined diameter when grouped together larger than hole 14 and mechanically forcing or stapling into holes 14 creating a tight fit which secures air pervious bristles 16 in place. Brush ring 13 is made with a slight (about 1°) inward tapered design along 23, which has its widest inside diameter of brush ring 13 at top diameter (opposite the bristles 16) and smallest inside diameter at the bristle core end, whereby the brush ring 13 when fitted over opening 12 will engage an increasingly tighter fit between cleaner head opening 12 and brush ring 13 as brush ring 13 is pushed upwards along cleaner head opening 12 when progressing towards tube connector 8. Thus, as the cleaner head 2 is pressed against the surface being cleaned this taper arrangement provides a continuous compression fit between the brush ring 13 and cleaner head 2 acting in the opposite direction of the taper. This tapered connection design allows for a quick exchange of worn out brush rings without permanent or mechanical attachment by forcing outward on brush ring 13 in the direction of the taper thereby dislodging the brush ring from the cleaner head 2, thereby eliminating the need for replacement of entire cleaning head 2 once bristles become worn.

Figure 2:
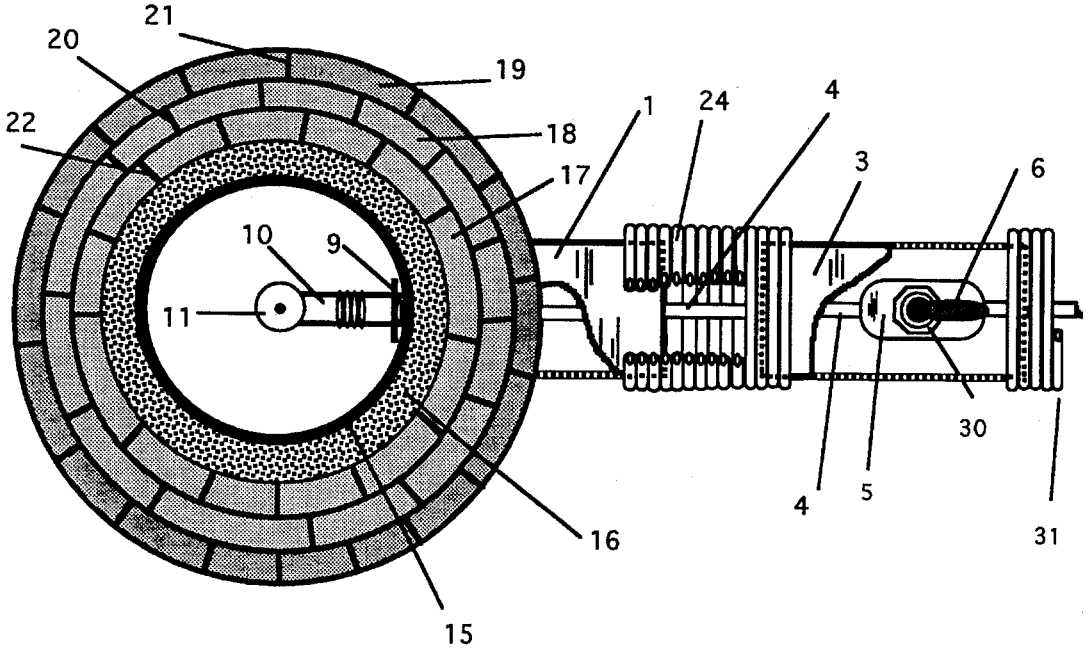
FIG. 2 is a top view looking at the brush head interior through the brush ring opening.
Figure 3:
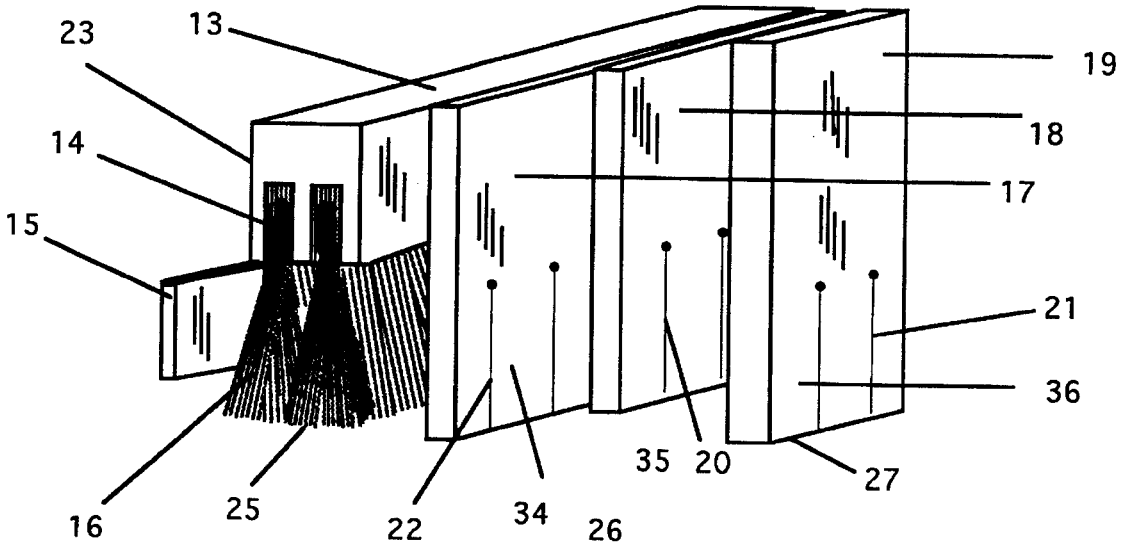
FIG. 3 is a part sectional detail view of the brush ring head showing arrangements of bristles and flexible foam layers.

Attached to brush ring 12, by means of gluing or other suitable method of attachment, is a primary layer of flexible air impervious foam ring 17 of exact outside diameter of brush ring 13 so as to form a continuous skirt around brush ring 13, aligned such that the bottom 26 of air impervious foam ring 17 is slightly lower than bristle bottoms 25 of air pervious brush bristles 16. Flexible foam ring 17 is constructed with equally spaced (FIG. 2) slits 22 forming flexible foam fingers 34 (FIG. 3) of about one half the overall height of foam ring 17. Attached to foam ring 17, by means of gluing or other suitable method of attachment, is a secondary layer of flexible air impervious foam ring 18 of exact outside diameter of foam ring 17 so as to form a continuous skirt around foam ring 17, and aligned such that the bottom 26 of foam ring 18 is the exact same height as foam ring 17. Flexible foam ring 18 is constructed with equally spaced (FIG. 2 ) slits 20 of about one half the overall height of foam ring 18, forming flexible foam fingers 35 and aligned with flexible foam ring 17 so that slits 22 of foam ring 17 and slits 20 of foam ring 18 form an alternating pattern between slits with independently flexing fingers 34 and 35 (FIG. 3)

Attached to foam ring 18, by means of gluing or other suitable method of attachment, is an outside final protective flexible air impervious foam ring 19 of exact outside diameter of foam ring 18 so as to form a continuous skirt around foam ring 18, aligned such that the bottom 27 of air impervious foam ring 19 is slightly lower than the air impervious foam rings 18 and 17. Flexible foam ring 18 is constructed with equally spaced slits 21 forming flexible foam fingers 36 of about one third the overall height of foam ring 19 and aligned with flexible foam ring 18 so that slits 21 of foam ring 19 and slits 20 of foam ring 18 form an alternating pattern between slits with independently flexing fingers 36.

An inner flexible ring 15 of air impervious material is glued or attached by other suitable means to the inside air pervious brush bristles 16 so as to form a throat to opening 12 of brush ring 13, and completely encircles bristles 16 and aligns along about three quarters of the length of the bristles 16. The flexible ring 15 acts to prevent the collapse of bristles 16 inward towards the cleaning head opening 12 during operation which would otherwise interfere with the vacuum effects and fluid spray pattern from nozzle 11. Flexible ring 15 is not slit and forms a continuous skirt or throat about the inside layer of bristles 16 and extend downward along the same plane from the end of cleaning head opening 12. Flexible ring 15 also acts to prevent the accidental contact of the hard surface of cleaning head opening 12 from contacting a delicate automotive surface if pushed onto the surface with great force or when contacting an irregular surface that may protrude into the cleaning head opening 12. The protective air impervious foam ring 19 is made of a more durable foam construction material to withstand the rigors of intended operation and protect the more delicate foam fingers 34 and 35 and aid to maintain suction over irregular surfaces as described.

In operation when a vehicle requires servicing by means of washing, the operator initiates the vacuum source connected to vacuum hose 31 and pressurize fluid pump supplying valve 5. The pressurized fluid may be water or may also be a soap/water mixture or other suitable cleaning agent that is dispersed by means of a proportioning valve connected into the fluid tube 4. The operator holds the fluid control valve frame housing 3 in one hand and the cleaning head assembly 2 in the other hand. The operator engages flow control lever or button 6 thereby unseating valve seat 29 and releasing a flow of pressurized fluid through tube 4 to the connector 8 into elbow 10 and through spray nozzle 11 which is dispersed in a circular pattern into the opening of cleaning head 2 and out of opening 12.

The operator holds the cleaning head assembly 2 against the surface to be cleaned, usually an automobile or truck body, but may also be used for other delicate surfaces, and positions the cleaning head 2 so as to maintain a compressive force of the flexible brush rings fingers 34, 35 and 36 to flex outwardly, against any flat surface, horizontally or vertically positioned, or around and over any irregular protrusions. The foam rings fingers 36 first and 35 and 34 together, form the initial contact to the surface. When connected to a vacuum source a slightly lower pressure forms within the foam ring at all times compared to the atmospheric surroundings. As pressurized water or soap/water mixture is dispersed in a circular pattern through nozzle 11, it is forced against the surface to be cleaned and is projected outwardly into contact with the surface and the cleaning bristles 16 and flexible foams rings fingers 34, 35 and 36. Water is contained within the confines of cleaning head 2, even when passed over irregular shaped or vertical surfaces by means of the overlapping foam fingers preventing encroachment of outside air which maintain vacuum. The agitation of the brush bristles 16 combined with the flex action of the flexible foam fingers 34, 35 and 36 acting independently, combined to loosen the surface dirt and quickly distribute the dirt into the water or soap/water stream. The pressurized fluid spray is projected with enough velocity so as to overcome the initial effects of the vacuum force created by the vacuum source connected to vacuum hose 31. However, the fluid velocity once dispersed against the surface being cleaned and upon mixture with the surface dirt, is diminished to the point where the negative pressure or vacuum effects within the cleaning head 2 of the vacuum source, overcomes the fluids ability to remain within the cleaning head cavity and becomes evacuated back to the vacuum source through cylindrical portion 1 and vacuum hose 24. The regulation of fluid flow is controlled by valve 5 and ensures that fluid build up and unintended fluid escape can be controlled by the operator. Vacuum effects are constant but fluid flow is intermittent according to control by the operator.

During use, the operator moves the wash head 2 back-and-forth or in a circular motion on vertical or horizontal surfaces with uninterrupted efficiencies. Excessively dirty surfaces would require additional passes of the wash head 2 to remove accumulated dirt build up. Additional passes of the cleaning head without fluid flow will remove trace residual water from the initial pass and can effectively clean the surface without the need to dry.

The unique features of the device is the ability to maintain watertight integrity within a cleaning brush ring due to the use of air impervious foam layers that make initial contact to the surface and are held below the subsequent layers of air pervious cleanings material. Another feature is the use of alternating layers of flexible foam fingers that maintain vacuum even when air impervious foam fingers are flexed or spread apart when moved over irregular surfaces.

Another unique feature of the present embodiment is the ability to quickly change worn brush rings and exchange for new brush rings without the use of mechanical connectors or attachments.

The advantages of this device is the ability to capture soap/water within a cleaning brush ring so as to comply with current environmental pollution discharge laws. Another advantage is the ability to clean vehicles within close proximity of each other without over spray resulting in contamination of adjacent vehicles or surroundings.

Yet another advantage of the invention is the very low water consumption required to clean a vehicle compared to other cleaning methods that employ a water based medium.

While in accordance with the patent statues a preferred embodiment of the present invention has been illustrated and described in detail. However, it is understood that the embodiments are not intended to limit the scope of the invention and they are presented only to teach the best modes contemplated for practicing this invention.

I claim:

1. A hand operated washing device suitable for cleaning automotive or truck surfaces that captures and recovers used water or water/soap medium, said device comprising:

a) a hollow brush ring frame housing having a circular narrow opening on one end and a dependent body portion of a wider circular opening on the other end;

b) a hollow valve frame housing with identical circular openings on both inlet and outlet ends onto which is mounted a valve for regulation of fluid flow and a means for controlling said fluid flow of said valve;

c) a suction hose and integral water delivery tube secured to said narrow opening on one end, and secured on the other end to the outlet end of the valve frame housing by a water delivery tube;

d) together with means having a suitable vacuum source and a fluid delivery tube secured to the inlet side of the mounted valve on said valve frame;

e) a bristle support ring surrounding said dependent body portion of brush ring frame having vertically dependent air pervious bristles, an inside band of non-air pervious foam forming a throat to said dependent bristles, a primary layer of flexible, non-air pervious foam surrounding said bristle support ring and dependent bristles, a secondary layer of non-air pervious foam surrounding said primary foam layer, and an outside layer of non-air pervious protective foam surrounding the primary and secondary said layers;

f) a spray nozzle mounted in said brush ring housing centrally of said depending body portion which is supplied by the water delivery tube extending through said hollow brush ring frame housing.

2. A brush ring frame housing as recited in claim 1 wherein the bottom end of said depending air pervious bristles is above the bottom end of said air impervious foam rings.

3. A brush ring frame housing as recited in claim 2 wherein the bottom end of the outside third layer of non-air pervious foam ring is below the bottom of the said secondary and primary non-air pervious foam layers.

4. A brush ring as recited in claim 2 wherein said foam rings are slit vertically at or about one half length at equal intervals around their circumference.

5. A brush ring as recited in claim 4 wherein said vertical slits of said primary, secondary and third protective foam rings layers are offset and positioned so as to have slits in alternating patterns when layered one over the other thereby restricting fluid escape or air entrance so as to maintain vacuum within the confines of the flexible foam fingers when positioned over flat or irregular surfaces.

* * * * *